US007160146B2

(12) United States Patent
Cawood et al.

(10) Patent No.: US 7,160,146 B2
(45) **Date of Patent: *Jan. 9, 2007**

(54) CONNECTOR INSULATING BOOT FOR DIFFERENT SIZED CONDUCTORS AND ASSOCIATED METHODS

(75) Inventors: Matthew D. Cawood, De Leon Springs, FL (US); Roy E. Jazowski, Port Orange, FL (US); Marc F. Salerno, Port Orange, FL (US); James L. Zahnen, Ormond Beach, FL (US)

(73) Assignee: Homac Mfg. Company, Ormond Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/380,093

(22) Filed: Apr. 25, 2006

(65) Prior Publication Data

US 2006/0180335 A1 Aug. 17, 2006

Related U.S. Application Data

(63) Continuation of application No. 10/781,317, filed on Feb. 18, 2004, now Pat. No. 7,056,151.

(60) Provisional application No. 60/499,144, filed on Aug. 29, 2003, provisional application No. 60/448,019, filed on Feb. 18, 2003.

(51) Int. Cl.
*H01R 13/52* (2006.01)

(52) U.S. Cl. ..... 439/521

(58) Field of Classification Search ..... 439/521, 439/522, 571; 174/85, 138, 87; 29/884, 29/874

See application file for complete search history.

(56) References Cited

U.S. PATENT DOCUMENTS 2,311,758 A 2/1943 Johansson ..... 174/65
2,419,683 A 4/1947 Henschke ..... 173/340

(Continued)

FOREIGN PATENT DOCUMENTS

DE 34 28 258 2/1986

(Continued)

OTHER PUBLICATIONS

Thomas and Betts 2002-2003, Blackburn Secondary Products, available at http://util-cat.tnb.com/ucon-img/utility_pages/index.html.

(Continued)

*Primary Examiner*—Alexander Gilman
(74) *Attorney, Agent, or Firm*—Allen, Dyer, Doppelt, Milbrath & Gilchrist, P.A.

(57) ABSTRACT

An electrical connector may include a conductive body having a conductor receiving passageway therein to receive the conductor of a cable end. The conductive body may also have a fastener receiving passageway intersecting the conductor receiving passageway, and a fastener may be positioned in the fastener receiving passageway for securing the conductor. The connector may also include an insulating boot associated with the conductor receiving passageway. The insulating boot may include an insulating tube, and at least one rupturable seal closing the insulating tube and rupturing upon initial insertion of the cable end therethrough. The rupturable seal may also be compliant to accommodate different sized cable ends and form a seal with adjacent portions of the cable end. A pair of seals may be provided with an optional sealant material therebetween.

38 Claims, 9 Drawing Sheets

U.S. PATENT DOCUMENTS

| | | | | |
|---|---|---|---|---|
| 2,932,685 | A | 4/1960 | Raila et al. | 174/84 |
| 3,009,986 | A | 11/1961 | Stephens | 174/84 |
| 3,020,260 | A | 2/1962 | Nelson | 260/46.5 |
| 3,467,768 | A | 9/1969 | Shorey | 174/138 |
| 3,480,905 | A | 11/1969 | Toedtman | 339/213 |
| 3,504,099 | A | 3/1970 | Beinhaur | 174/72 |
| 3,528,051 | A | 9/1970 | Toedtman et al. | 339/101 |
| 3,602,871 | A * | 8/1971 | Newman | 439/724 |
| 3,644,878 | A | 2/1972 | Toedtman | 339/213 R |
| 3,710,307 | A | 1/1973 | Cooper, Jr. | 339/116 C |
| 3,740,692 | A | 6/1973 | Filhaber | 339/19 |
| 3,874,760 | A | 4/1975 | Guthmiller et al. | 339/60 R |
| 3,983,314 | A | 9/1976 | Filhaber | 174/138 |
| 4,192,569 | A | 3/1980 | Mucci | 439/204 |
| 4,283,597 | A | 8/1981 | Cooper, Jr. | 174/138 F |
| 4,369,284 | A | 1/1983 | Chen | 524/476 |
| 4,411,491 | A | 10/1983 | Larkin et al. | 385/73 |
| 4,425,017 | A | 1/1984 | Chan | 339/96 |
| 4,595,635 | A | 6/1986 | Dubrow et al. | 428/447 |
| 4,600,261 | A | 7/1986 | Debbaut | 339/116 C |
| 4,634,207 | A | 1/1987 | Debbaut | 339/116 C |
| 4,680,233 | A | 7/1987 | Camin et al. | 428/424.6 |
| 4,701,574 | A | 10/1987 | Shimirak et al. | 174/93 |
| 4,716,183 | A | 12/1987 | Gamarra | 522/80 |
| 4,721,832 | A | 1/1988 | Toy | 174/87 |
| 4,777,063 | A | 10/1988 | Dubrow et al. | 427/44 |
| 4,852,646 | A | 8/1989 | Dittmer et al. | 165/185 |
| 4,880,676 | A | 11/1989 | Puigcerver et al. | 428/35.7 |
| 4,888,070 | A | 12/1989 | Clark et al. | 156/48 |
| 4,942,270 | A | 7/1990 | Gamarra | 174/93 |
| 4,963,700 | A | 10/1990 | Olsen et al. | 174/138 F |
| 5,023,402 | A | 6/1991 | King, Jr. et al. | 174/87 |
| 5,079,300 | A | 1/1992 | Dubrow et al. | 525/106 |
| 5,099,088 | A | 3/1992 | Usami et al. | 174/76 |
| 5,132,495 | A | 7/1992 | Ewing et al. | 174/138 F |
| 5,140,476 | A | 8/1992 | Kim | 360/77.06 |
| 5,149,281 | A | 9/1992 | Hills et al. | 439/521 |
| 5,177,143 | A | 1/1993 | Chang et al. | 524/848 |
| 5,357,057 | A | 10/1994 | Debbaut | 174/84 |
| 5,529,508 | A | 6/1996 | Chiotis et al. | 439/204 |
| 5,533,912 | A | 7/1996 | Fillinger et al. | 439/521 |
| 5,561,269 | A | 10/1996 | Robertson et al. | 174/92 |
| 5,588,856 | A | 12/1996 | Collins et al. | 439/204 |
| 5,772,462 | A | 6/1998 | Osten | 439/367 |
| 5,824,954 | A | 10/1998 | Biche et al. | 174/74 A |
| 5,828,005 | A | 10/1998 | Huynh-Ba et al. | 174/92 |
| 5,848,913 | A | 12/1998 | Ashcraft | 439/521 |
| 5,895,890 | A | 4/1999 | Uchiyama et al. | 174/77 |
| 5,915,998 | A | 6/1999 | Stidham et al. | 439/723 |
| 5,962,811 | A | 10/1999 | Rodrigues et al. | 174/76 |
| 6,025,559 | A | 2/2000 | Simmons | 174/87 |
| 6,263,567 | B1 | 7/2001 | McGrane | 29/884 |
| RE37,340 | E | 8/2001 | King, Jr. | 174/87 |
| 6,347,966 | B1 | 2/2002 | Hielscher | 439/798 |
| 6,359,226 | B1 | 3/2002 | Biddell et al. | 174/74 |
| 6,730,847 | B1 | 5/2004 | Fitzgerald et al. | 174/77 R |
| 2002/0102874 | A1 | 8/2002 | Hobson et al. | 439/271 |

FOREIGN PATENT DOCUMENTS

| | | |
|---|---|---|
| DE | 90 04 669 | 6/1990 |
| EP | 0 108 518 | 5/1984 |
| EP | 0 203 737 | 12/1986 |
| EP | 0 328 386 | 8/1999 |
| FR | 1388822 | 12/1963 |
| WO | 88/00603 | 1/1988 |
| WO | 90/05401 | 5/1990 |
| WO | 95/15600 | 6/1995 |
| WO | 95/24756 | 9/1995 |
| WO | 96/23007 | 8/1996 |
| WO | 97/42693 | 11/1997 |

OTHER PUBLICATIONS

Copy of International Search Report for PCT/US03/38594 (mailing date Apr. 27, 2004).

Homac Mfg. Company, Fact Sheet,"*Flood-Seal"® Rubberized Aluminum Bar* .

* cited by examiner

CONNECTOR INSULATING BOOT FOR DIFFERENT SIZED CONDUCTORS AND ASSOCIATED METHODS

RELATED APPLICATION

This application is a continuation of U.S. patent application Ser. No. 10/781,317 filed Feb. 18, 2004 now U.S. Pat. No. 7,056,151 which is based upon prior filed copending provisional application Ser. Nos. 60/448,019 filed Feb. 18, 2003 and 60/499,144 filed Aug. 29, 2003. The entire contents which are incorporated herein by reference in their entirety.

FIELD OF THE INVENTION

The invention relates to the field of electrical connectors, and, more particularly, to electrical insulator boots used in electrical connectors for electrical distribution systems and associated methods.

BACKGROUND OF THE INVENTION

Underground and submersible junction bus connectors are widely used in electrical power distribution systems. One type of such connector is offered under the designation SWEETHEART® by Homac Mfg. Company of Ormond Beach, Fla., the assignee of the present invention. The SWEETHEART® connector is a cast or welded aluminum connector including an elongate bus portion and a series of tubular posts extending outwardly from the bus portion. The posts have an open upper end to receive one or more electrical conductors. A threaded bore is provided in the sidewall of the post to receive a fastener to secure the electrical conductor within the upper end of the post. U.S. Pat. No. 6,347,966, for example, discloses such a connector and a method for securing the posts to the bus portion.

An insulating coating is provided on the lower portion of the posts and bus of the connector. In addition, EPDM insulating boots or rockets may be used to provide waterproof seals to the insulating outer jacket of the wire or cable. These boots include an insulating tube having a lower end to be received onto the connector post. The upper end or end cap includes a series of progressively smaller diameter step or ring portions. An installer selects at which ring to cut the boot cap so that the resulting opening is properly sized for the diameter of electrical cable or wire to be received therein. U.S. Pat. No. 5,533,912 discloses a similar arrangement; however, the insulating boot with a stepped shape is positioned within a receiving port in an inverted configuration.

Unfortunately, water ingress, particularly where the boot is intended to seal against the jacket of the cable end, may result in corrosion and failure of the connector. When properly installed, such boots do not permit water ingress. Unfortunately, if improperly installed the seal provided by the boot may not be sufficient to keep water out. Accordingly, water may enter and degrade the electrical connection resulting in premature failure of the connector.

There is also a trend to require less highly skilled craftsman to install the connectors as a cost savings measure for utilities and their subcontractors. Instances of improper installation are more likely to occur as training and skill levels are reduced, and while at the same time greater production rates are required. For example, an improperly trained installer may cut the boot at a ring that is too large to correctly seal. Of course, the larger the ring, the less insertion force required to position the cable through the boot. Months or years after installation, water may penetrate the area of the seal and cause connector failure.

Other electrical connector insulator boots are described in U.S. Pat. No. 2,932,965 to Raila et al.; U.S. Pat. No. 3,740,692 to Filhaber; and U.S. Pat. No. 4,283,597 to Cooper, Jr. Unfortunately, these also may fail to provide proper sealing and/or accommodate different sized cable ends.

SUMMARY OF THE INVENTION

In view of the foregoing background, it is therefore an object of the present invention to provide an electrical connector and insulating boot that is more easily installed and with an increased margin for error during installation.

This and other objects, features and advantages in accordance with the present invention are provided by an electrical connector for at least one electrical cable end comprising a conductor and an insulating jacket thereover. The electrical connector may comprise a conductive body having at least one conductor receiving passageway therein to receive the conductor of the at least one cable end. The conductive body may also have at least one fastener receiving passageway intersecting the at least one conductor receiving passageway, and at least one fastener may be positioned in the at least one fastener receiving passageway for securing the conductor. The connector may also include at least one insulating boot associated with the at least one conductor receiving passageway. The insulating boot in one class of embodiments may comprise an insulating tube, and at least one rupturable seal closing the insulating tube and rupturing upon initial insertion of the cable end therethrough. In addition, the at least one rupturable seal may also be compliant to accommodate different sized cable ends and form a seal with adjacent portions of the insulating jacket.

The at least one rupturable seal may comprise a layer having a plurality of radially oriented lines of weakness therein. Alternately or additionally, the at least one rupturable seal may comprise a layer having a plurality of successive concentric rings of weakness therein. The at least one rupturable seal may also additionally or alternately comprise a layer being puncturable and having a percentage elongation to yield of not less than about 300 percent, for example. The at least one rupturable seal may be, for example, more compliant than the insulating tube. The insulating boot may comprise a thermoplastic elastomer in some embodiments.

The insulating boot may further comprise an elastic body contained within the insulating tube for urging the at least one rupturable seal radially inward, in some embodiments. The insulating boot further may also comprise a sealant material and/or a lubricant within the insulating tube. The insulating tube may also include a series of gripping rings on an interior proximal end thereof.

In some embodiments, the at least one rupturable seal comprises a first rupturable seal at a distal end of the insulating tube, and a second rupturable seal at a medial portion of the insulating tube. For example, the first rupturable seal may comprise a first rupturable seal connected to the distal end of the insulating tube. The second rupturable seal may comprise a second rupturable seal integrally molded with the insulating tube. In these embodiments, the insulating boot may further comprise a sealant material between the first and second rupturable seals.

The electrical connector in other embodiments may comprise a conductive body having at least one conductor receiving passageway therein to receive the conductor of the at least one cable end, and at least one insulating boot associated with the at least one conductor receiving passageway. The insulating boot may include an insulating tube having a proximal end to be positioned adjacent the conductive body, a distal end opposite the proximal end, and a medial portion between the proximal and distal ends. In addition, the insulating boot may include a first seal at the distal end of the insulating tube that is penetrable upon insertion of the cable end therethrough, and a second seal at the medial portion of the insulating tube that is penetrable upon insertion of the cable end therethrough. The first and second seals may also be compliant to accommodate different sized cable ends and form respective seals with adjacent portions of the cable end.

Another aspect of the invention is directed to an insulating boot for an electrical connector comprising a conductive body having at least one conductor receiving passageway therein to receive a conductor of at least one cable end. The insulating boot may include an insulating tube having a proximal end to be positioned adjacent the conductive body, a distal end opposite the proximal end, and a medial portion between the proximal and distal ends. A first seal may be at the distal end of the insulating tube that is penetrable upon insertion of the cable end therethrough, and a second seal may be at the medial portion of the insulating tube that is penetrable upon insertion of the cable end therethrough. The first and second seals may be compliant to accommodate different sized cable ends and form respective seals with adjacent portions of the cable end.

In some embodiments, the first seal may be connected to the distal end of the insulating tube and be penetrable upon insertion of the cable end therethrough, and wherein the first seal is more compliant than the insulating tube. In addition, the second seal may be integrally formed with the insulating tube at the medial portion thereof and be penetrable upon insertion of the cable end therethrough. A sealant material may be provided within the insulating tube between the first and second seals.

In still other embodiments, the insulating boot may include an insulating tube, and at least one rupturable seal closing the insulating tube and rupturing upon initial insertion of the cable end therethrough. In these embodiments, the at least one rupturable seal may have a percentage elongation to yield of not less than about 300 percent to thereby be compliant to accommodate different sized cable ends and form a seal with adjacent portions of the cable end.

Another aspect of the invention relates to a method for making an electrical connector for at least one electrical cable end comprising a conductor and an insulating jacket thereover. The method may include forming a conductive body having at least one conductor receiving passageway therein to receive the conductor of the at least one cable end, the conductive body also having at least one fastener receiving passageway intersecting the at least one conductor receiving passageway. The method may also include providing at least one fastener positioned in the at least one fastener receiving passageway for securing the conductor within the at least one conductor-receiving passageway. Moreover, the method may also include forming at least one insulating boot associated with the at least one conductor receiving passageway by forming an insulating tube, and at least one rupturable seal closing the insulating tube and rupturing upon initial insertion of the cable end therethrough. The at least one rupturable seal may also be compliant to accommodate different sized cable ends and form a seal with adjacent portions of the insulating jacket.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation are used to indicate similar elements in alternate embodiments.

Figure 1A:
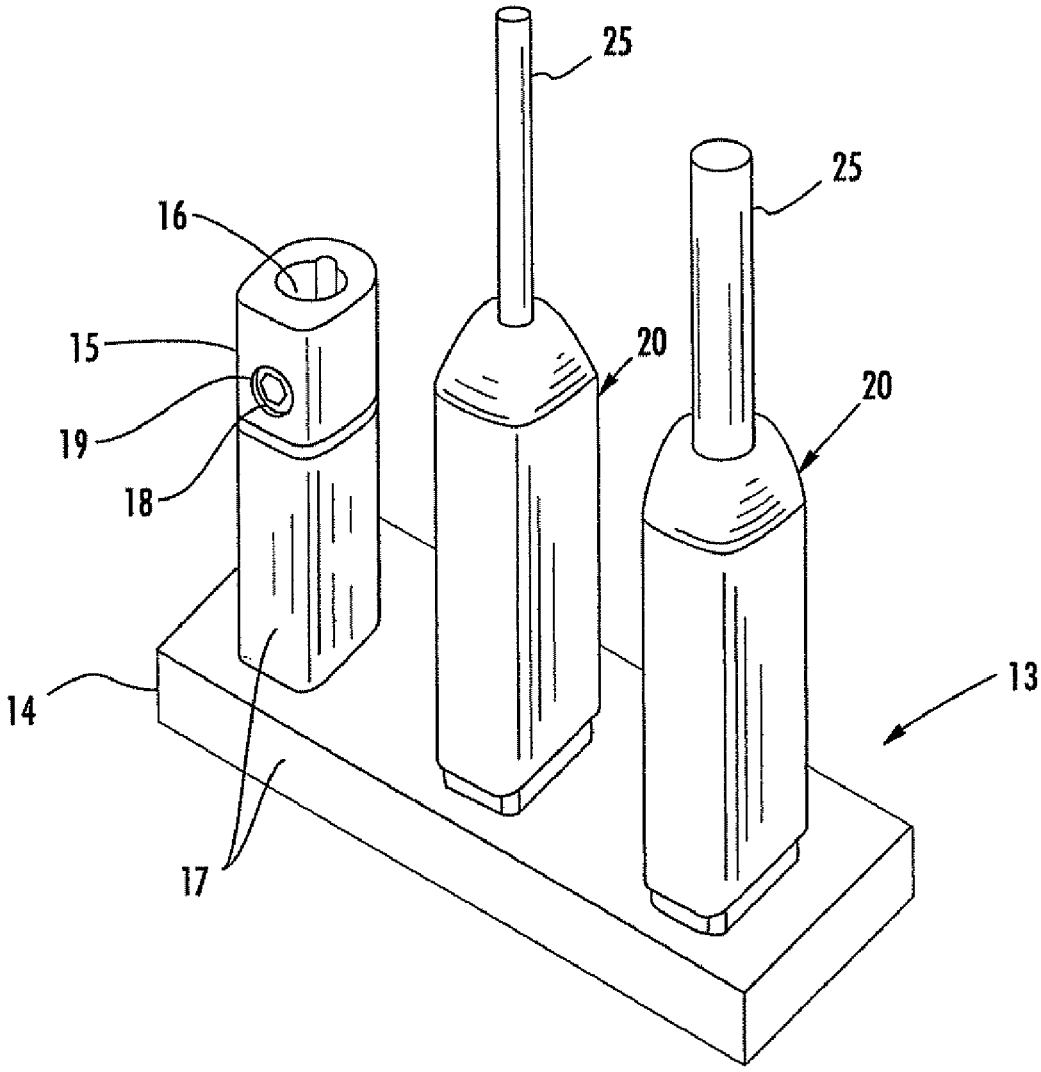
FIG. 1A is a perspective view of an electrical connector in accordance with the present invention illustrating different sized cable ends being received by the connector.
Figure 1B:
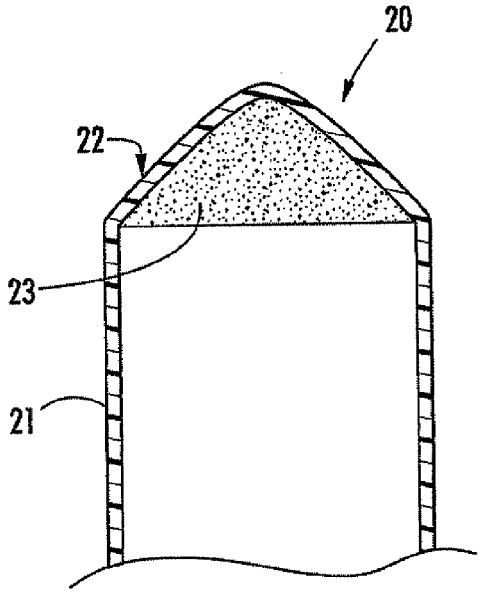
FIGS. 1B and 1C are respective schematic cross-sectional views of a first embodiment of an insulating boot of the present invention prior to and after installation of a cable therein.
Figure 1C:
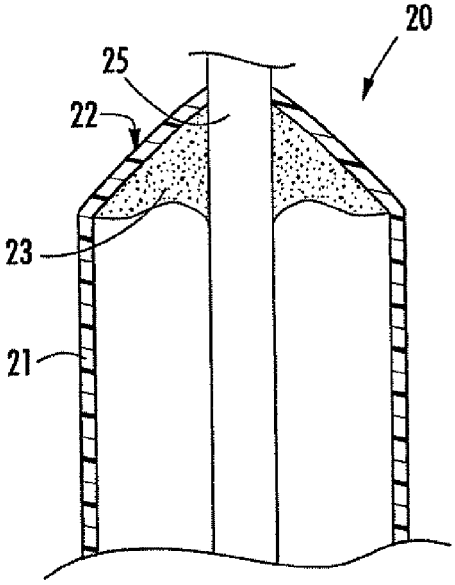

Referring initially to FIGS. 1A through 1C, a first embodiment of an insulating boot 20 for an electrical connector 13 in accordance with the invention is now described. As shown in FIG. 1A, the electrical connector 13 includes a conductive body in the form of a bar-shaped bus 14 and a series of posts 15 extending upwardly therefrom. An insulating layer 17 is provided over the bus 14 and lower portions of the posts 15. Each post 15 includes a conductor receiving passageway 16 therein to receive the conductor of the corresponding cable end. As shown with reference to the leftmost post of FIG. 1A, the posts 15 of the conductive body also have a fastener receiving passageway 19 intersecting the at least one conductor receiving passageway 16. A fastener 18 is positioned in the fastener receiving passageway 19 for securing the conductor of the cable end as will be appreciated by those skilled in the art. As will also be appreciated by those skilled in the art, multiple fasteners can be used and other configurations of conductive bodies are also contemplated by the present invention.

For clarity of explanation, only the upper end of the insulating boot 20 is shown in FIGS. 1B and 1C, the lower end being of a typical construction to be slidably fitted into sealing engagement with another member, such as the upper end of the connector post 15 and its lower insulation coated end, as will be appreciated by those skilled in the art. Of course, the insulating boot 20 can be used for other types of connections as will also be appreciated by those skilled in the art.

In the illustrated embodiment, the boot 20 includes a tubular insulating sidewall 21 or insulating tube ending in a tapered or conical end cap 22 that defines a rupturable seal. By rupturable is meant having a continuous surface prior to initial penetration.

The end cap seal 22 illustratively contains a body of sealant material 23 and can advantageously receive a wire or cable of different widths therethrough, yet provide a tight and moisture resistant seal therewith. The sealant material 23 may be a mastic or moisture barrier gel that will adhere to the cable 25 and adjacent boot portions to form a water resistant seal as will be appreciated by those skilled in the art. Since the cable 25 is typically inserted through the end cap seal 22 and then the boot 20 is slid forward along the cable, this action will likely spread the layer of sealant material 23 to be positioned between the cable and the adjacent boot portions.

The end cap seal 22 is desirably rupturable along a line of weakness, for example, in some embodiments, to permit positioning of the cable 25 therethrough without requiring careful cutting as in the prior art. The sealant material 23 also forms a barrier to keep water and moisture out of the interior of the boot 20 and away from the electrical connection. The end cap seal 22 is also preferably stretchable or compliant to receive wires or cables 25 of different diameters, for example. For example, the end cap seal 22 may have a percentage of elongation to yield of not less than about 300 percent. This may accommodate different cable sizes of from No. 8 up to 350 kcmil, for example, although other sizes are also possible.

Figure 2A:
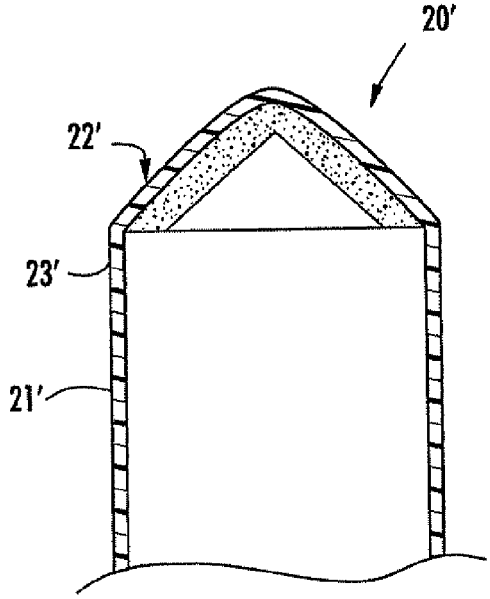
FIGS. 2A and 2B are respective schematic cross-sectional views of a second embodiment of an insulating boot of the present invention prior to and after installation of a cable therein.
Figure 2B:
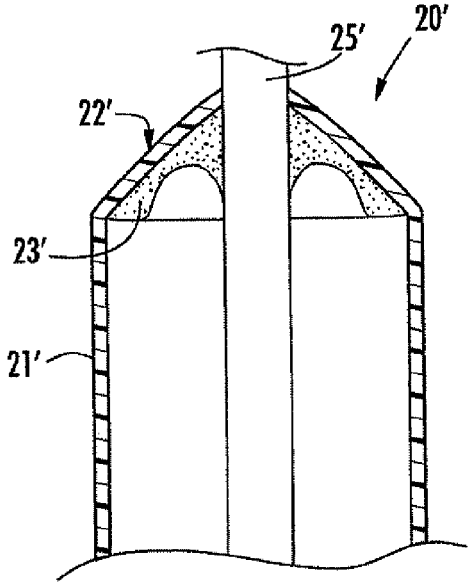

Turning now to FIGS. 2A and 2B, a second embodiment of the boot 20' is now described. This embodiment is similar to that described above with reference to FIGS. 1B and 1C, but in this embodiment, the sealant material 23' is in the form of a layer lining the interior of the end cap 22'. The other elements and operation are similar to that of the boot 20 described above and no further explanation is required.

Figure 3A:
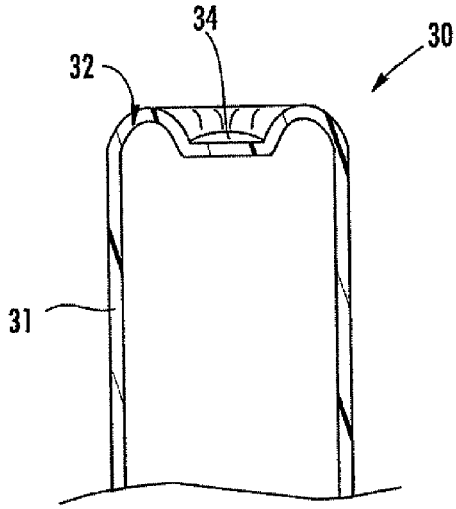
FIGS. 3A and 3B are respective schematic cross-sectional views of a third embodiment of an insulating boot of the present invention prior to and after installation of a cable therein.
Figure 3B:
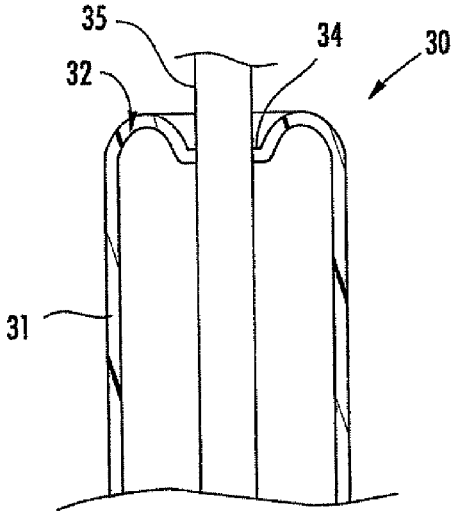

Referring now to FIGS. 3A and 3B, a third embodiment of an insulating boot 30 is now described. In this embodiment, the boot 30 includes a tubular sidewall 31 or insulating tube and an inverted end cap 32. More particularly, the inverted end cap 32 illustratively includes rounded over peripheral edges and a rupturable medial portion 34. The rupturable medial portion 34 is left unruptured if no cable is present on a given connector post as will be appreciated by those skilled in the art. If a cable 35 is positioned through the boot 30 (FIG. 3B) the rupturable medial portion 34 is ruptured as the cable end is forced therethrough. A seal is formed between the cable 35 and the adjacent portions of the end cap seal 32.

Figure 4A:
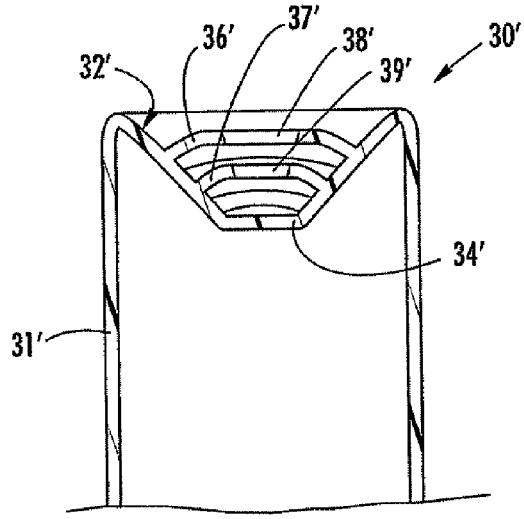
FIGS. 4A and 4B are respective schematic cross-sectional views of a fourth embodiment of an insulating boot of the present invention prior to and after installation of a cable therein.
Figure 4B:
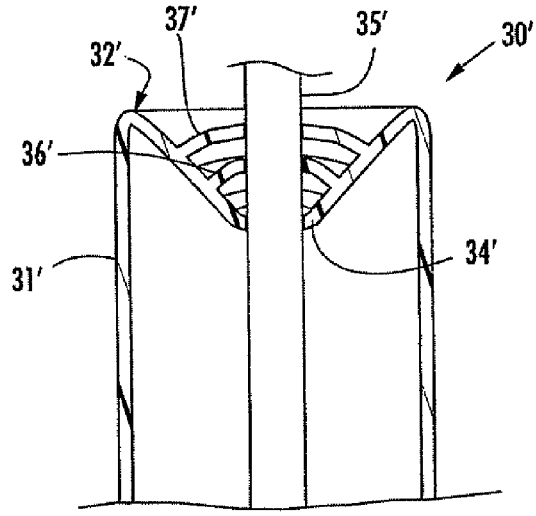

Additional seals may be provided to the inverted boot as shown by the embodiment of FIGS. 4A and 4B. In particular, in this embodiment the boot 30' also includes a pair of ring-shaped wiper seals 36', 37' that extend inwardly toward an axis of the boot. These wiper seals 36', 37' provide additional sealing contact areas for the cable 35' as seen in FIG. 4B. Only a single wiper seal may be used in some variations, and more than two wiper seals can be used in other embodiments as will be appreciated by those skilled in the art. The wipers 36', 37' may have preformed openings 38', 39' therein as shown in the illustrated embodiment. These openings 38', 39' may have different sizes or may be the same size. The term penetrable is used herein to include seals that are either continuous or that have an initial opening therein as do the wiper seals, for example. In yet other variations, the openings may be closed with a rupturable portion much like the rupturable medial portion 34' although molding may be more difficult.

Figure 5A:
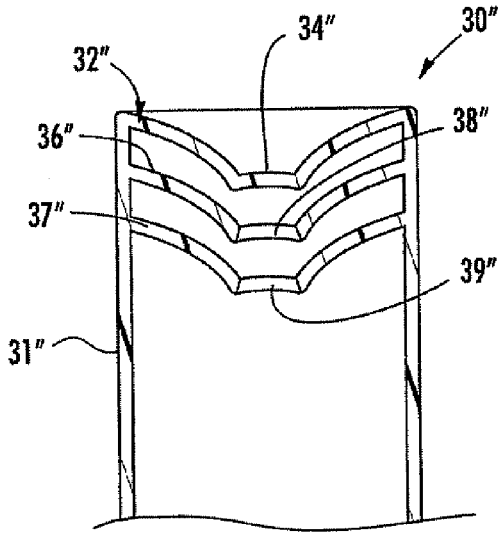
FIGS. 5A and 5B are respective schematic cross-sectional views of a fifth embodiment of an insulating boot of the present invention prior to and after installation of a cable therein.
Figure 5B:
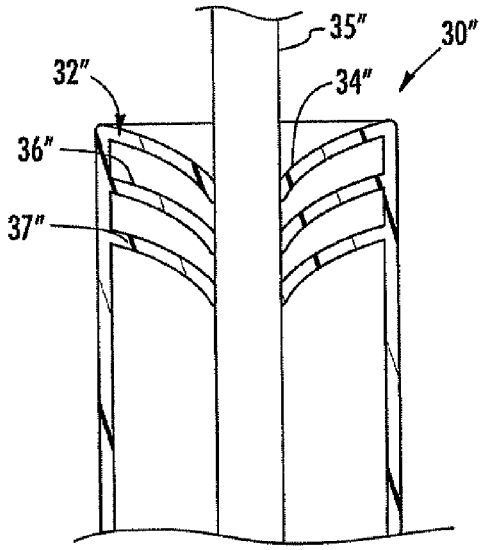

Turning now to FIGS. 5A and 5B, a fifth embodiment of the boot 30" according to the invention is now described. This boot 30" is similar to the third and fourth embodiments described above; however, in this embodiment, the wiper seals 36", 37" are provided inside the tubular sidewall 31" or insulating tube and the rupturable medial portion 34" is provided on the outside. The operation and additional sealing are provided by the rupturable medial portion 34" as well as the pair of wipers 36", 37" as described above and as will be appreciated by those skilled in the art. The wipers 36", 37" may have corresponding openings 38", 39" to facilitate molding as shown in the illustrated embodiment.

Figure 6A:
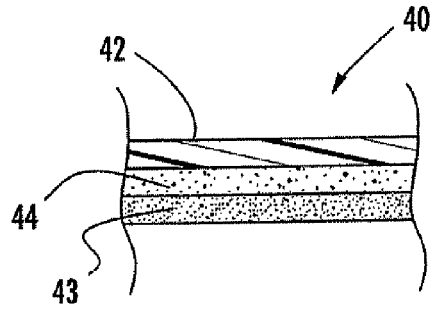
FIGS. 6A and 6B are respective schematic cross-sectional views of a sixth embodiment of an insulating boot of the present invention prior to and after installation of a cable therein.
Figure 6B:
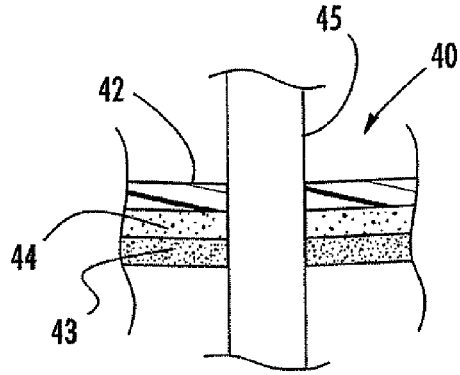

Referring now additionally to FIGS. 6A and 6B other aspects of the invention are now described. The illustrated boot 40 includes an end cap seal 42 through which the cable 45 will be positioned (FIG. 6B). A lubricant layer 44 is positioned next to the end cap seal 42 on an interior surface thereof. This lubricant 44 may be a silicone based lubricant or other lubricant that facilitates relatively sliding of the cable 45 and adjacent portions of the end cap seal 42 as the cable is positioned through the end cap, for example. Accordingly, installation is made easier and quicker for the installer.

As also shown in FIGS. 6A and 6B, a sealant material layer 43 may also be provided adjacent the inner surface of the lubricant layer 44. This sealant layer 43 may serve to hold the lubricant layer 44 in place, and thereafter assist in sealing to the cable 45 as will be appreciated by those skilled in the art. The lubricant layer 44 also keeps the sealant material 43 from pulling down along the cable 45. This optional lubricant layer 44, and/or sealant material layer 43 may be used in any of the insulating boot embodiments described herein as will also be appreciated by those skilled in the art.

Figure 7A:
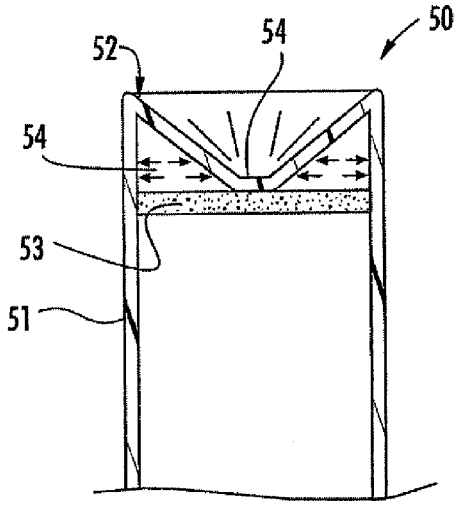
FIGS. 7A and 7B are respective schematic cross-sectional views of a seventh embodiment of an insulating boot of the present invention prior to and after installation of a cable therein.
Figure 7B:
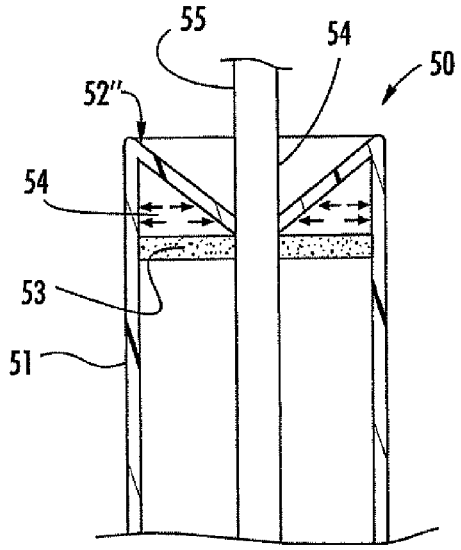

Referring now to FIGS. 7A and 7B a seventh embodiment of an insulating boot 50 in accordance with the invention is now described. This boot 50 illustratively includes a tubular sidewall 51 or insulating tube and an inverted end cap seal 52 connected thereto. The end cap seal 52 also illustratively includes a rupturable medial portion 54 as described above for receipt of a cable 55 therethrough (FIG. 7B). In this embodiment a compressible or elastic ring-shaped body 54 is provided between the inverted end cap seal 52 and adjacent inner surfaces of the sidewall 51. The compressible or elastic body 54 provides an inward bias to provide a greater sealing force onto the cable 55 as will be appreciated by those skilled in the art.

The compressible or elastic body 54 may be provided by a closed cell foam, for example, although other materials are also contemplated by the invention. The boot 50 also illustratively includes an optional sealant material layer 53 positioned beneath the compressible body 54. This sealant material layer 53 may be provided for additional sealing as described above.

Figure 8A:
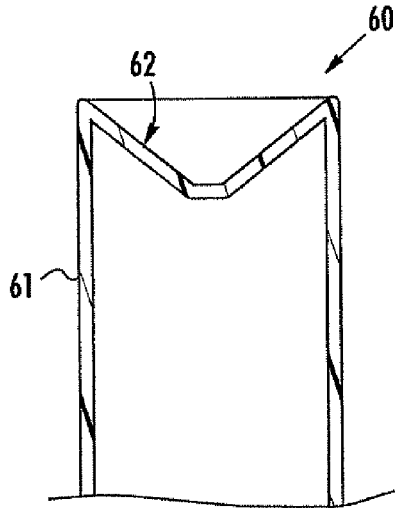
FIGS. 8A and 8B are respective schematic cross-sectional views of an eighth embodiment of an insulating boot of the present invention prior to and after installation of a cable therein.
Figure 8B:
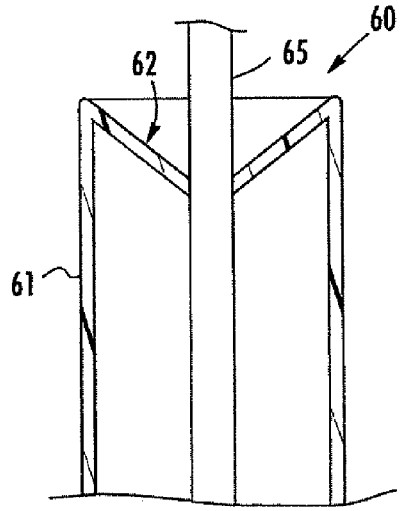

Referring now to the eighth embodiment of the boot 60 as shown in FIGS. 8A and 8B, in this embodiment, the end cap seal 62 may be more compliant than the sidewall 61. For example, the end cap seal 62 may have a different durometer than the sidewall 61. In other words, the sidewall 61 may be less bendable than the end cap seal 62. The sidewall 61 could also be made thicker than the end cap seal 62. Other variations are also contemplated by the present invention as will be appreciated by those skilled in the art.

Figure 9A:
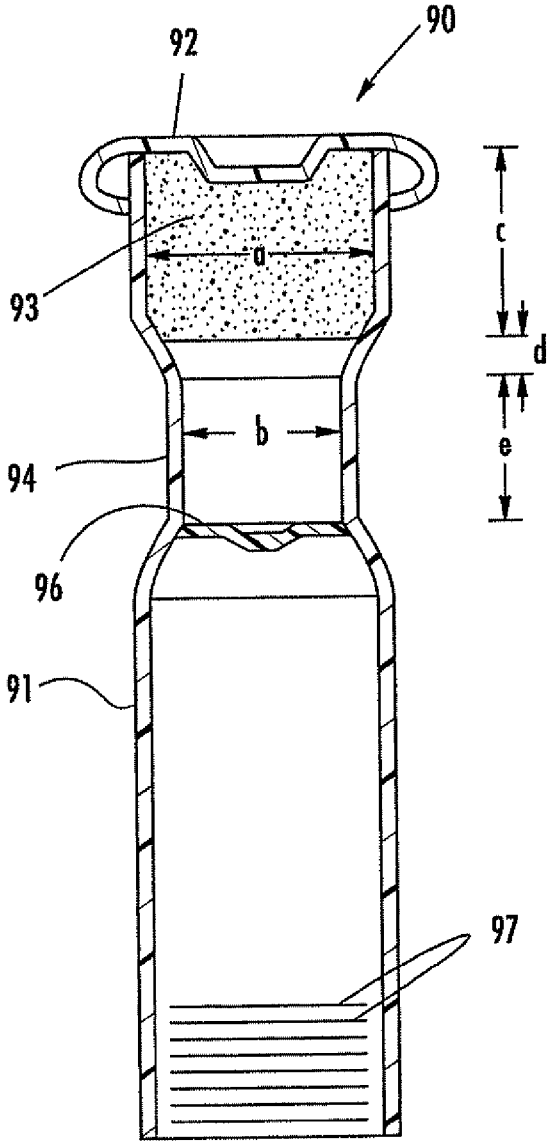
FIGS. 9A and 9B are respective schematic cross-sectional views of a ninth embodiment of an insulating boot of the present invention prior to and after installation of a cable therein.
Figure 9B:
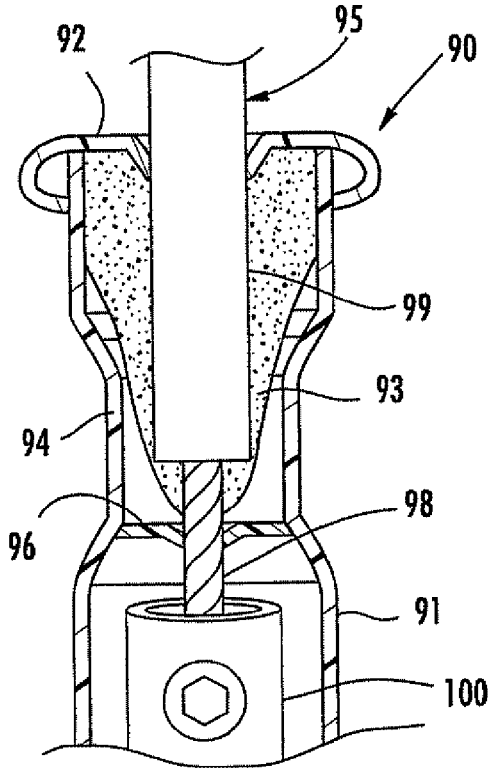

Referring now to FIGS. 9A and 9B another embodiment of an insulating boot 90 is now described. In this embodiment, the tubular sidewall 91 includes a reduced diameter portion 94 spaced inwardly from the end cap seal 92. The boot 90 also includes a medial or intermediate seal 96 at the lower end of the reduced diameter portion 94 creating an internal sealing chamber. A body or mass of sealant material 93 fills the uppermost portion of the sealing chamber, while the lower portion of the sealing chamber is empty to permit displacement of the sealant material 93 and to accommodate the cable 95 as it is inserted into the boot go (FIG. 9B). The sealing chamber may also retain the sealant material 93 if the cable is subsequently withdrawn from the boot 90. It is noted that sealing gel, for example, may be relatively expensive, such as about $9/lb., and the positioning of the gel only partly filling the sealing chamber provides a cost effective approach to sealing as will be appreciated by those skilled in the art, The reduced diameter portion 94 of the sidewall 91 may serve to retain the sealing gel 93 in the uppermost position so that it can coat the cable 95 during insertion. This reduced diameter portion 94 may also be more readily grasped by an installer.

Optional horizontal gripping ribs 97 are formed on the internal surface of the lowermost or proximal end of the boot 70. The end cap seal 92 and intermediate seal 96 may include rings of weakness or other features to permit penetration and sealing as discussed in detail above and as will be appreciated by those skilled in the art. Approximate dimensions for the embodiment of FIGS. 9A and 9B are as follows: a=1.25", b=1", c=1", d=0.25", and e=0.75". Other sizes are also possible as will be appreciated by those skilled in the art.

As can be seen in FIG. 9B, the cable 95 may include stranded conductors 98 extending outwardly from the end of the surrounding cable jacket 99. The interface between the stranded conductors 98 and end of the jacket 99 is illustratively contacted by the sealant material 93 as the cable 95 is inserted into the boot 90. Water migrating from this interface is also likely to be trapped in the sealing chamber. Accordingly, this embodiment of the boot 90 may be especially advantageous for reducing the likelihood of water coming into contact with the electrical connector 100, a portion of which is shown in FIG. 9B.

Figure 10A:
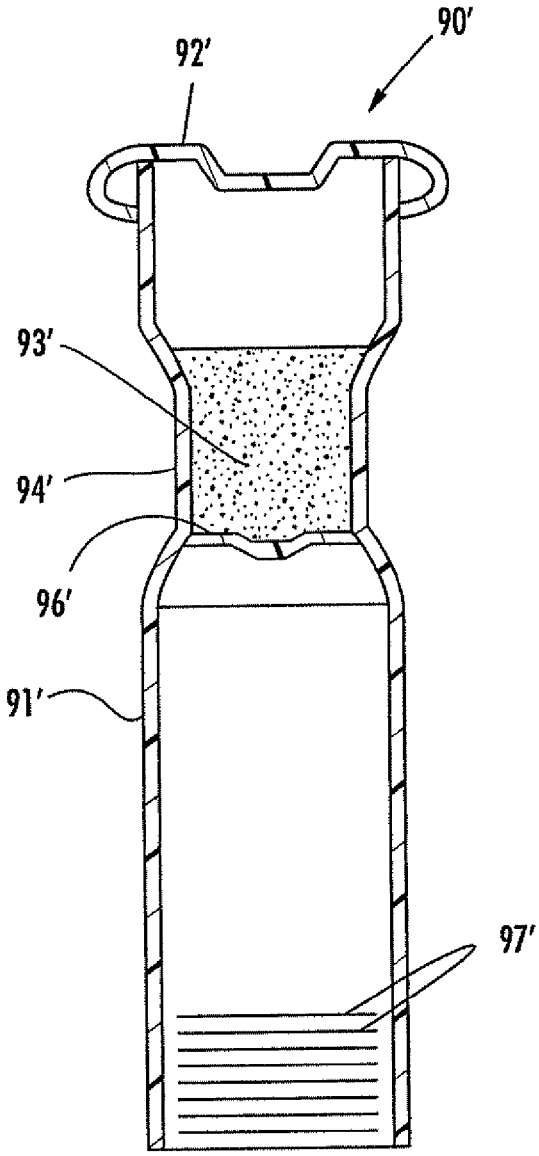
FIGS. 10A and 10B are respective schematic cross-sectional views of a tenth embodiment of an insulating boot of the present invention prior to and after installation of a cable therein.
Figure 10B:
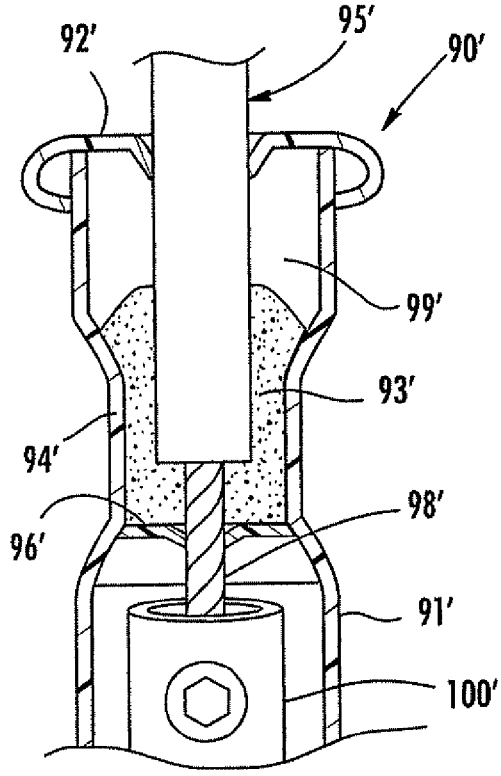

A tenth embodiment of the insulating boot 90' is now explained with additional reference to FIGS. 10A and 10B. In this embodiment, the sealant material 93' is positioned adjacent the intermediate seal 96' and an open space is left above the sealant material in the uppermost portion adjacent the end cap seal 92'. As will be appreciated by those skilled in the art, this embodiment of the insulating boot 90' can provide effective sealing and/or accommodate entry of the cable 95' with a reduced quantity of the sealant material 93'. Those other elements of the tenth embodiment of the boot 90' are similar to those of the ninth embodiment of the insulating boot 90 discussed above with reference to FIGS. 9*a* and 9B, and these elements are indicated with prime notation and require no further discussion herein.

Figure 11A:
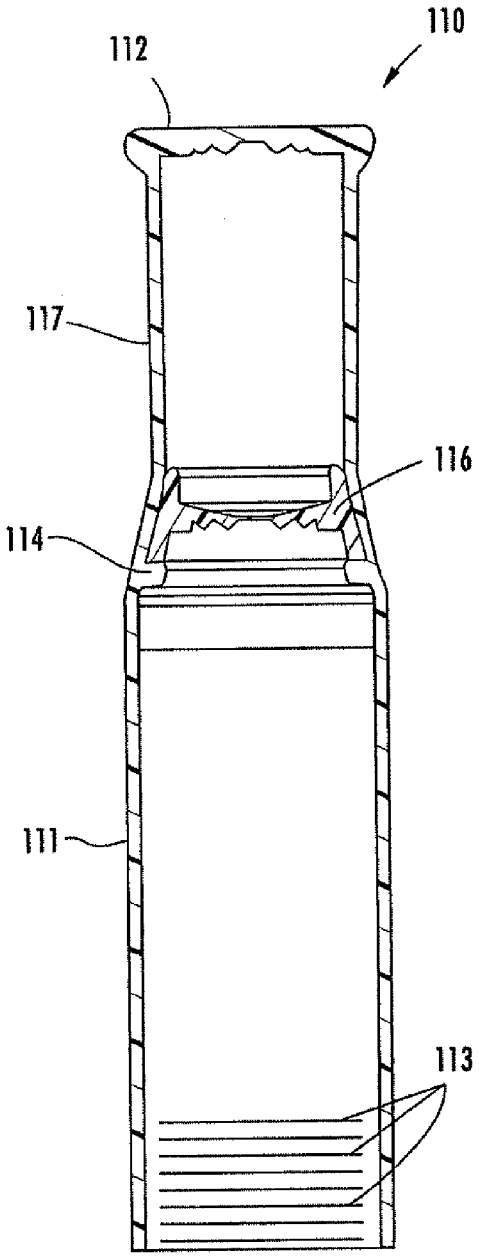
FIGS. 11A and 11B are respective schematic cross-sectional views of an eleventh embodiment of an insulating boot of the present invention prior to and after installation of a cable therein.
Figure 11B:
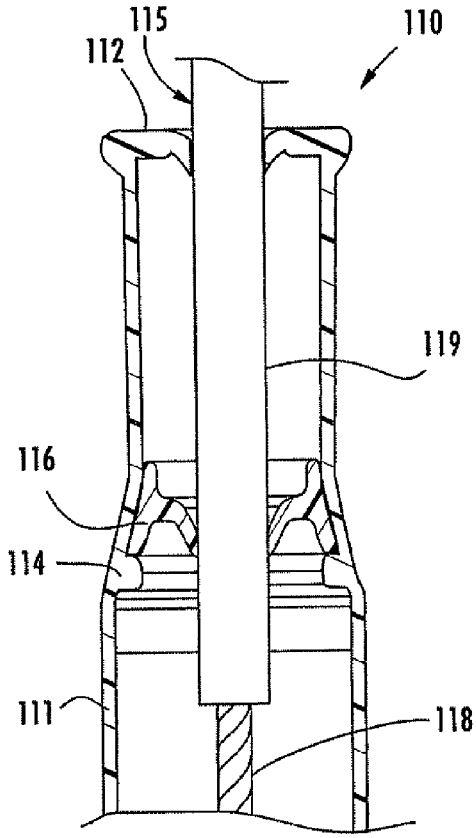

Turning now additionally to FIGS. 11A and 11B, an eleventh embodiment of the insulating boot 110 is now described. In this embodiment, the tubular sidewall 111 or insulating tube and the end cap seal 112 may be integrally molded as a single unit. The end cap seal 112 may include concentric lines of weakness as described above. Moreover, the intermediate seal 116 in this embodiment is provided as a separately molded unit that is assembled to reside between the reduced diameter upper portion 117 and the molded ledge 114. The intermediate seal 116 may also include concentric lines of weakness or other features permitting insertion of different sized cables 115 as described herein. Optional gripping ribs 113 are also provided on an internal surface of the distal end of the sidewall 111 in the illustrated embodiment.

As shown in the illustrated embodiment of the boot 110, the interface between the end of the cable jacket 119 and the electrical conductors 118 may be positioned past the intermediate seal 116. In yet other embodiments, the boot 110 may include a sealant material therein, and the interface between the end of the jacket 119 and conductors 118 may be positioned in the sealing chamber defined between the end cap 112 and the intermediate seal 116 as will be appreciated by those skilled in the art.

Figure 12A:
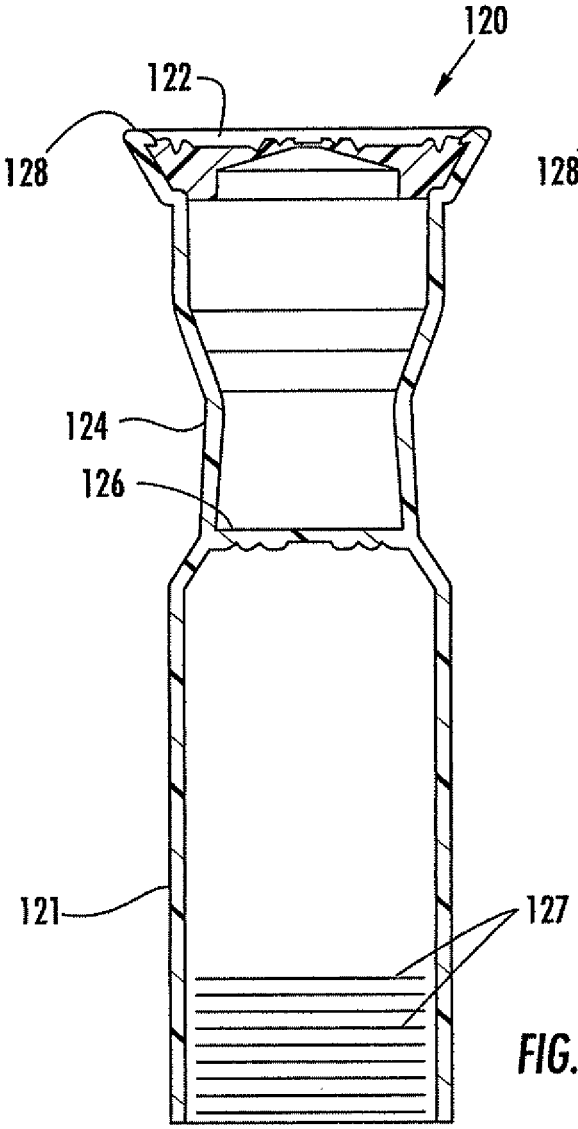
FIGS. 12A and 12B are respective schematic cross-sectional views of a twelfth embodiment of an insulating boot of the present invention prior to and after installation of a cable therein.
Figure 12B:
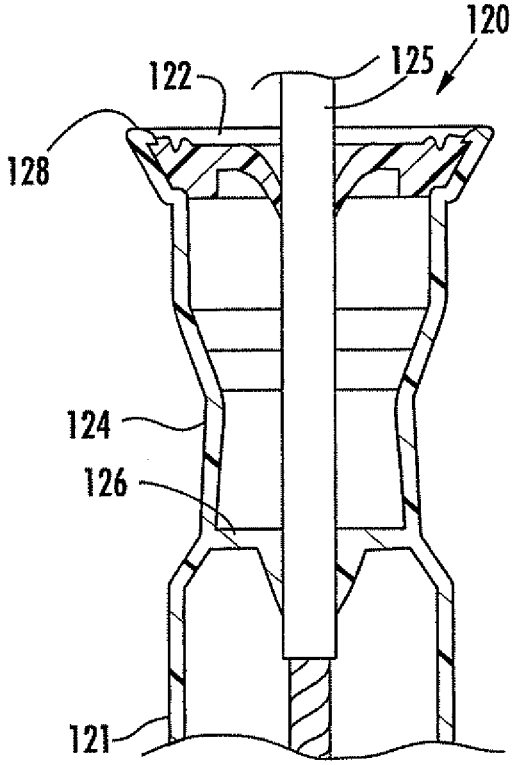

Referring now to FIGS. 12A and 12B another class of embodiments of the insulating boot 120 is now described. Somewhat similar to the eleventh embodiment described above, this twelfth embodiment includes an integrally formed unit and a seal assembly added thereto. More particularly, the boot 120 includes a tubular sidewall 121 or insulating tube with an integrally molded intermediate seal 126. The end cap seal 122 and/or other portions of the boot 120 may be formed of a thermoplastic elastomeric (TPE) material, for example. Indeed, TPE materials may be used in any of the insulating boot embodiments described herein. Other suitable insulating materials may also be used as will be appreciated by those skilled in the art.

The end cap or end seal 122 is molded as a separate unit and is inserted into a recess 128 formed in the uppermost end of the sidewall 121. A reduced diameter portion 124 is provided in the illustrated embodiment, but may not be used in other embodiments. In addition, optional gripping ribs 127 are also shown in the illustrated embodiment. The end cap seal 122 and intermediate seal 126 define a sealing chamber therebetween that may contain a sealant material in some embodiments. A cable 125 is installed through the end cap 122 and through the intermediate seal 126 as shown in FIG. 12*b*.

Figure 12C:
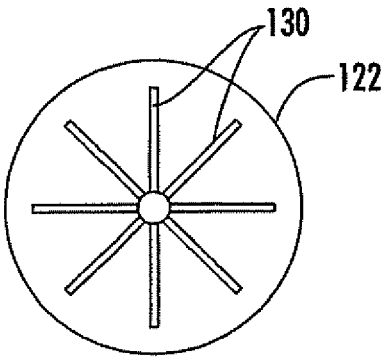
FIG. 12C is a top plan view of the end cap seal as shown in FIGS. 12A and 12B.
Figure 12D:
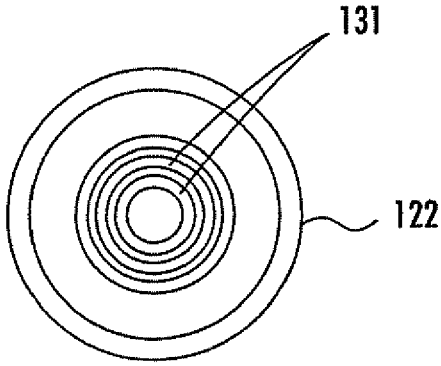
FIG. 12D is a bottom plan view of the end cap seal as shown in FIGS. 12A and 12B.

As shown in FIG. 12C, the end cap seal 122 may include a pattern or radial lines of weakness 130 on its upper surface and which have a reduced thickness as compared to adjacent portions. As shown in FIG. 12D, concentric rings of weakness 131 may be provided on the underside of the end cap seal 122. These patterns or configurations of weakness can also be used on the intermediate seal 126 or used on any of the seal embodiments disclosed herein.

A method aspect of the invention is for making an electrical connector for at least one electrical cable end comprising a conductor and an insulating jacket thereover. The method may include forming a conductive body having at least one conductor receiving passageway therein to receive the conductor of the at least one cable end, the conductive body also having at least one fastener receiving passageway intersecting the at least one conductor receiving passageway. The method may also include providing at least one fastener positioned in the at least one fastener receiving passageway for securing the conductor within the at least one conductor-receiving passageway. Moreover, the method may also include forming at least one insulating boot associated with the at least one conductor receiving passageway by forming an insulating tube, and at least one rupturable seal closing the insulating tube and rupturing upon initial insertion of the cable end therethrough. The at least one rupturable seal may also be compliant to accommodate different sized cable ends and form a seal with adjacent portions of the insulating jacket.

Other methods are also contemplated by the present invention based upon the connector and/or insulating boots described herein. Indeed, many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that other modifications and embodiments are intended to be included within the scope of the appended claims.

That which is claimed is:

1. An electrical connector for at least one electrical cable end comprising a conductor, the electrical connector comprising:

a conductive body having at least one conductor receiving passageway therein to receive the conductor of the at least one electrical cable end; and at least one insulating structure associated with said at least one conductor receiving passageway and comprising an insulating tube having a proximal portion adjacent said conductive body and a distal portion spaced from the proximal portion, a first penetrable wall at a fixed position within the distal portion of said insulating tube, a second penetrable wall at a fixed position within the proximal portion of said insulating tube, said first and second penetrable walls each being configured to accommodate different sized cable ends therethrough, said first and second penetrable walls defining a sealant material-receiving chamber therebetween, and a sealant material within the sealant-receiving chamber defined between said first and second penetrable walls;

at least one of said first and second penetrable walls being integrally molded with adjacent portions of said insulating tube.

2. An electrical connector according to claim 1 wherein said conductive body also has at least one fastener receiving passageway intersecting the at least one conductor receiving passageway; and further comprising at least one fastener positioned in the at least one fastener receiving passageway for securing the conductor within the at least one conductor receiving passageway.

3. An electrical connector according to claim 1 wherein said first and second penetrable walls are each compliant to accommodate different sized cable ends.

4. An electrical connector according to claim 1 wherein said first and second penetrable walls are each compliant to accommodate different sized cable ends and form a respective seal with adjacent portions of the cable end.

5. An electrical connector according to claim 1 wherein at least one of said first and second penetrable walls has a plurality of radially oriented lines of weakness therein.

6. An electrical connector according to claim 1 wherein at least one of said first and second penetrable walls has a plurality of successive concentric rings of weakness therein.

7. An electrical connector according to claim 1 wherein at least one of said first and second penetrable walls is puncturable and has a percentage elongation to yield of not less than about 300 percent.

8. An electrical connector according to claim 1 wherein at least one of said first and second penetrable walls is more compliant that said insulating tube.

9. An electrical connector according to claim 1 wherein said at least one insulating structure comprises a thermoplastic elastomer.

10. An electrical connector according to claim 1 wherein said at least one insulating structure further comprises a tubular sidewall within said insulating tube and carrying said second penetrable wall.

11. An electrical connector according to claim 1 wherein at least one of said first and second penetrable walls has an initial opening therein prior to penetration of the cable end therethrough.

12. An electrical connector according to claim 1 wherein said sealant material only partially fills the sealant-receiving chamber.

13. An electrical connector for at least one electrical cable end comprising a conductor, the electrical connector comprising:

a conductive body having at least one conductor receiving passageway therein to receive the conductor of the at least one cable end; and at least one insulating structure associated with said at least one conductor receiving passageway and comprising an insulating tube having a proximal portion adjacent said conductive body and a distal portion spaced from the proximal portion, a first penetrable wall at a fixed position within the distal portion of said insulating tube, a tubular sidewall at a fixed position within the proximal portion of said insulating tube, said insulating tube comprising an interior ledge abutting said tubular sidewall, a second penetrable wall carried by said tubular sidewall and formed as an integrally molded unit therewith, said first and second penetrable walls defining a sealant material-receiving chamber therebetween, and a sealant material within the sealant-receiving chamber defined between said first and second penetrable walls of said insulating tube.

14. An electrical connector according to claim 13 wherein said first and second penetrable walls are each compliant to accommodate different sized cable ends.

15. An electrical connector according to claim 13 wherein at least one of said first and second penetrable walls has a plurality of radially oriented lines of weakness therein.

16. An electrical connector according to claim 13 wherein at least one of said first and second penetrable walls is puncturable and has a percentage elongation to yield of not less than about 300 percent.

17. An electrical connector according to claim 13 wherein at least one of said first and second penetrable walls is more compliant that said insulating tube.

18. An electrical connector according to claim 13 wherein said at least one insulating structure comprises a thermoplastic elastomer.

19. An electrical connector according to claim 13 wherein said first penetrable wall is integrally molded with adjacent portions of said insulating tube.

20. An electrical connector according to claim 13 wherein at least one of said first and second penetrable walls has an initial opening therein prior to penetration of the cable end therethrough.

21. A method for making an electrical connector for at least one electrical cable end comprising a conductor, the method comprising:

providing a conductive body having at least one conductor receiving passageway therein to receive the conductor of the at least one electrical cable end; and associating at least one insulating structure with the at least one conductor receiving passageway and comprising an insulating tube having a proximal portion adjacent the conductive body and a distal portion spaced from the proximal portion, a first penetrable wall at a fixed position within the distal portion of the insulating tube, a second penetrable wall at a fixed position within the proximal portion of the insulating tube, the first and second penetrable walls each being configured to accommodate different sized cable ends therethrough, the first and second penetrable walls defining a sealant material-receiving chamber therebetween, and a sealant material within the sealant-receiving chamber defined between the first and second penetrable walls, at least one of the first and second penetrable walls being integrally molded with adjacent portions of the insulating tube.

22. A method according to claim 21 wherein the first and second penetrable walls are each compliant to accommodate different sized cable ends.

23. A method according to claim 21 wherein the first and second penetrable walls are each compliant to accommodate different sized cable ends and form a respective seal with adjacent portions of the cable end.

24. A method according to claim 21 wherein at least one of the first and second penetrable walls has a plurality of radially oriented lines of weakness therein.

25. A method according to claim 21 wherein at least one of the first and second penetrable walls is puncturable and has a percentage elongation to yield of not less than about 300 percent.

26. A method according to claim 21 wherein at least one of the first and second penetrable walls is more compliant that the insulating tube.

27. A method according to claim 21 wherein the at least one insulating structure comprises a thermoplastic elastomer.

28. A method according to claim 21 wherein the at least one insulating structure further comprises a tubular sidewall within the insulating tube and carrying the second penetrable wall.

29. A method according to claim 21 wherein at least one of the first and second penetrable walls has an initial opening therein prior to penetration of the cable end therethrough.

30. A method for making an electrical connector for at least one electrical cable end comprising a conductor, the method comprising:

providing a conductive body having at least one conductor receiving passageway therein to receive the conductor of the at least one cable end; and associating at least one insulating structure associated with the at least one conductor receiving passageway and comprising an insulating tube having a proximal portion adjacent the conductive body and a distal portion spaced from the proximal portion, a first penetrable wall at a fixed position within the distal portion of the insulating tube, a tubular sidewall at a fixed position within the proximal portion of the insulating tube, the insulating tube comprising an interior ledge abutting the tubular sidewall, a second penetrable wall carried by the tubular sidewall and formed as an integrally molded unit therewith, the first and second penetrable walls defining a sealant material-receiving chamber therebetween, and a sealant material within the sealant-receiving chamber defined between the first and second penetrable walls of the insulating tube.

31. A method according to claim 30 wherein the first and second penetrable walls are each compliant to accommodate different sized cable ends.

32. A method according to claim 30 wherein the first and second penetrable walls are each compliant to accommodate different sized cable ends and form a respective seal with adjacent portions of the cable end.

33. A method according to claim 30 wherein at least one of the first and second penetrable walls has a plurality of radially oriented lines of weakness therein.

34. A method according to claim 30 wherein at least one of the first and second penetrable walls is puncturable and has a percentage elongation to yield of not less than about 300 percent.

35. A method according to claim 30 wherein at least one of the first and second penetrable walls is more compliant that the insulating tube.

36. A method according to claim 30 wherein the at least one insulating structure comprises a thermoplastic elastomer.

37. A method according to claim 30 wherein the first penetrable wall is integrally molded with adjacent portions of the insulating tube.

38. A method according to claim 30 wherein at least one of the first and second penetrable walls has an initial opening therein prior to penetration of the cable end therethrough.

* * * * *

UNITED STATES PATENT AND TRADEMARK OFFICE

CERTIFICATE OF CORRECTION

PATENT NO. : 7,160,146 B2
APPLICATION NO. : 11/380093
DATED : January 9, 2007
INVENTOR(S) : Matthew D. Cawood et al.

It is certified that error appears in the above-identified patent and that said Letters Patent is hereby corrected as shown below:

| | |
|---|---|
| Title Page, Item (56) Page 2, Section Foreign Patent Documents | Delete: "EP 0 328 386 8/1999"<br>Insert: --EP 0 328 386 8/1989-- |
| Column 7, Line 43 | Delete: "the boot go"<br>Insert: --the boot 90-- |
| Column 7, Line 50 | Delete: "the art,"<br>Insert: --the art.-- |
| Column 8, Line 21 | Delete: "9*a* and 9B,"<br>Insert: --9A and 9B,-- |
| Column 9, Line 3 | Delete: "FIG. 12*b*."<br>Insert: --FIG. 12B.-- |
| Column 10, Line 30 | Delete: "compliant that said"<br>Insert: --compliant than said-- |
| Column 11, Line 16 | Delete: "compliant that said"<br>Insert: --compliant than said-- |
| Column 12, Line 3 | Delete: "that the"<br>Insert: --than the-- |

UNITED STATES PATENT AND TRADEMARK OFFICE

CERTIFICATE OF CORRECTION

PATENT NO. : 7,160,146 B2
APPLICATION NO. : 11/380093
DATED : January 9, 2007
INVENTOR(S) : Matthew D. Cawood et al.

It is certified that error appears in the above-identified patent and that said Letters Patent is hereby corrected as shown below:

| | |
|---|---|
| Column 12, Line 55 | Delete: "that the"<br>Insert: --than the-- |

Signed and Sealed this

Twenty-first Day of August, 2007

JON W. DUDAS
*Director of the United States Patent and Trademark Office*